US005566990A

United States Patent [19]

Watabe et al.

[11] Patent Number: 5,566,990

[45] Date of Patent: Oct. 22, 1996

[54] LATCH DEVICE

[75] Inventors: Masayuki Watabe; Kenji Nishiumi, both of Saitama, Japan

[73] Assignee: Kabushiki Kaisha Nippon Conlux, Japan

[21] Appl. No.: 442,114

[22] Filed: May 16, 1995

Related U.S. Application Data

[62] Division of Ser. No. 218,636, Mar. 28, 1994, Pat. No. 5,505,289.

[30] Foreign Application Priority Data

Feb. 4, 1993 [JP] Japan ..... 5-16415 U
Mar. 31, 1993 [JP] Japan ..... 5-74126

[51] Int. Cl.[6] ..... E05C 19/12

[52] U.S. Cl. ..... 292/95; 292/121

[58] Field of Search ..... 194/206, 207, 194/348; 271/180, 181; 292/95, 121, 219, DIG. 38

[56] References Cited

U.S. PATENT DOCUMENTS

| | | | |
|---|---|---|---|
| 343,756 | 6/1886 | Clemson | 292/219 |
| 891,852 | 6/1908 | Muirhead | 292/95 X |
| 3,797,870 | 3/1974 | Beckman | 292/DIG. 38 |
| 4,880,096 | 11/1989 | Kobayashi et al. | 221/198 X |
| 4,930,821 | 6/1990 | Jang | 292/DIG. 38 |

*Primary Examiner*—F. J. Bartuska
*Attorney, Agent, or Firm*—Diller, Ramik & Wight, PC

[57] ABSTRACT

A bill processor temporarily collects liquid entering the processor body through the liquid inlet and guided below a bill inlet or guided along a tilted bottom surface of the processor body in a liquid collector disposed at the bottom of a front cover which is provided with the bill inlet, and then discharges the liquid to the outside of a device to which the bill processor is mounted through a liquid guiding member connected to the liquid collector.

5 Claims, 11 Drawing Sheets

LATCH DEVICE

This application is a division of application Ser. No. 08/218,636, filed Mar. 28, 1994, now U.S. Pat. No. 5,505, 289.

BACKGROUND OF THE INVENTION

1. Field of the Invention

This invention relates to a bill processor which is used in such devices as vending machines, money exchangers or money service machines to judge the genuineness of bills inserted into the processors and receive and store bills judged as genuine, and more particularly to a bill processor capable of preventing liquid entering through a bill inlet of the bill processor from flowing into the device on which the bill processor is mounted.

2. Description of the Related Art

Generally, a vending machine, a money exchanger or a money service device is provided with a bill processor which judges the genuineness of an inserted bill and receives and stores only bills which are judged as genuine.

Referring to FIG. 13 illustrating a conventional bill processor 1 provided within a device such as a vending machine, the bill processor 1 has a body 2 being substantially L-shaped as viewed from its side, and a protruded front cover 4 having a bill inlet 3 disposed at a front lower end of the body 2.

The bill processor 1 is mounted on a door 5, which is a front panel of the vending machine, such that the protruded front cover 4 is exposed outside the door 5 so that a bill is inserted through the bill inlet 3. When a bill is inserted into the bill inlet 3, a bill sensor (not shown) disposed directly downstream of the bill inlet 3 senses the inserted bill to produce a bill detection signal.

A first conveyor belt 7 and a second conveyor belt 8 which constitute a first bill conveyance path 6 are provided directly downstream of the bill inlet 3. A drive motor (not shown) is disposed which drives the second conveyor belt 8 such that the first conveyor belt 7 is driven following the second conveyor belt 8.

In response to the bill detection signal, the first conveyer belt 7 is driven forward (clockwise) and the second conveyer belt 8 is driven backward (counterclockwise) so as to convey the bill horizontally into the body 2.

A bill validator (not shown) is disposed substantially at a midpoint along the first bill conveyance path 6. The bill conveyed horizontally the forward movement of the first conveyor belt 7, its genuineness is judged by the bill validator.

When the bill is judged as a false one, the first conveyor belt 7 is reversed (counterclockwise) to return the bill to outside the bill inlet 3. At this time, the second conveyor belt 8 is also reversed (clockwise).

When the bill is judged as a genuine one, the first conveyor belt 7 and the second conveyor belt 8 continue to be driven forward and backward, respectively, in response to the detection signal so that the bill is conveyed upward within the body 2 along a second bill conveyance path 9 which includes the upstanding second conveyor belt 8 and then stacked and received on a stacker 10A provided behind the body 2.

In the conventional bill processor 1, when drops of rain or adhesive liquid such as detergent flows into the bill inlet 3 as shown by an arrow A, the liquid falls below the bill inlet 3 or through the first bill conveyance path 6 downward onto the periphery of a bottom plate 11A of the body 2, then leak from below the body 2 and flow into the inside of the vending machine where the bill processor 1 is mounted.

The liquid would adhere to the various components of the vending machine such as driving members, printed circuit boards or electronic devices to cause these components to malfunction. As a result, the vending machine on which the bill processor 1 is mounted may stop its operation.

SUMMARY OF THE INVENTION

It is an object of the present invention to provide a bill processor which prevents liquid entering from a bill inlet to its body from flowing into a device on which the processor is mounted.

In order to achieve the above object, the present invention provides a bill processor for judging the genuineness of a bill inserted into the processor through a bill inlet formed in a front cover thereof, and storing the bill in a stacker which is supported at a body of the processor when the bill is judged as a genuine one, comprising a tilted surface provided at a lower end of the processor body, for guiding liquid which enters through the bill inlet and drops onto the lower end of the processor body toward the front cover; and a liquid collecting means provided at the bottom of the front cover, for collecting the liquid guided from the bill inlet and the tilted surface; and liquid guiding means connected to the liquid collecting means so that the liquid collected in the liquid collecting means is discharged through the liquid guiding means to outside of the processor body.

According to the bill processor, the liquid entering through the bill inlet flows to a position below the bill inlet and into a lower portion of the body through the bill conveyance path directly downstream of the bill inlet. The liquid flown below the bill inlet is received directly in the liquid collector and the liquid flowing into the lower portion of the body is received in the collector through the tilted surface where the liquid is temporarily stored, and discharged through the liquid guiding means connected to the liquid receiver to outside the device on which the bill processor is mounted.

Other objects and advantages of this invention will easily be confirmed on the basis of the following detailed description, when taken in conjunction with the attached drawings.

DESCRIPTION OF THE PREFERRED EMBODIMENTS

One embodiment of a bill processor according to this invention will be described in detail below.

Figure 1:
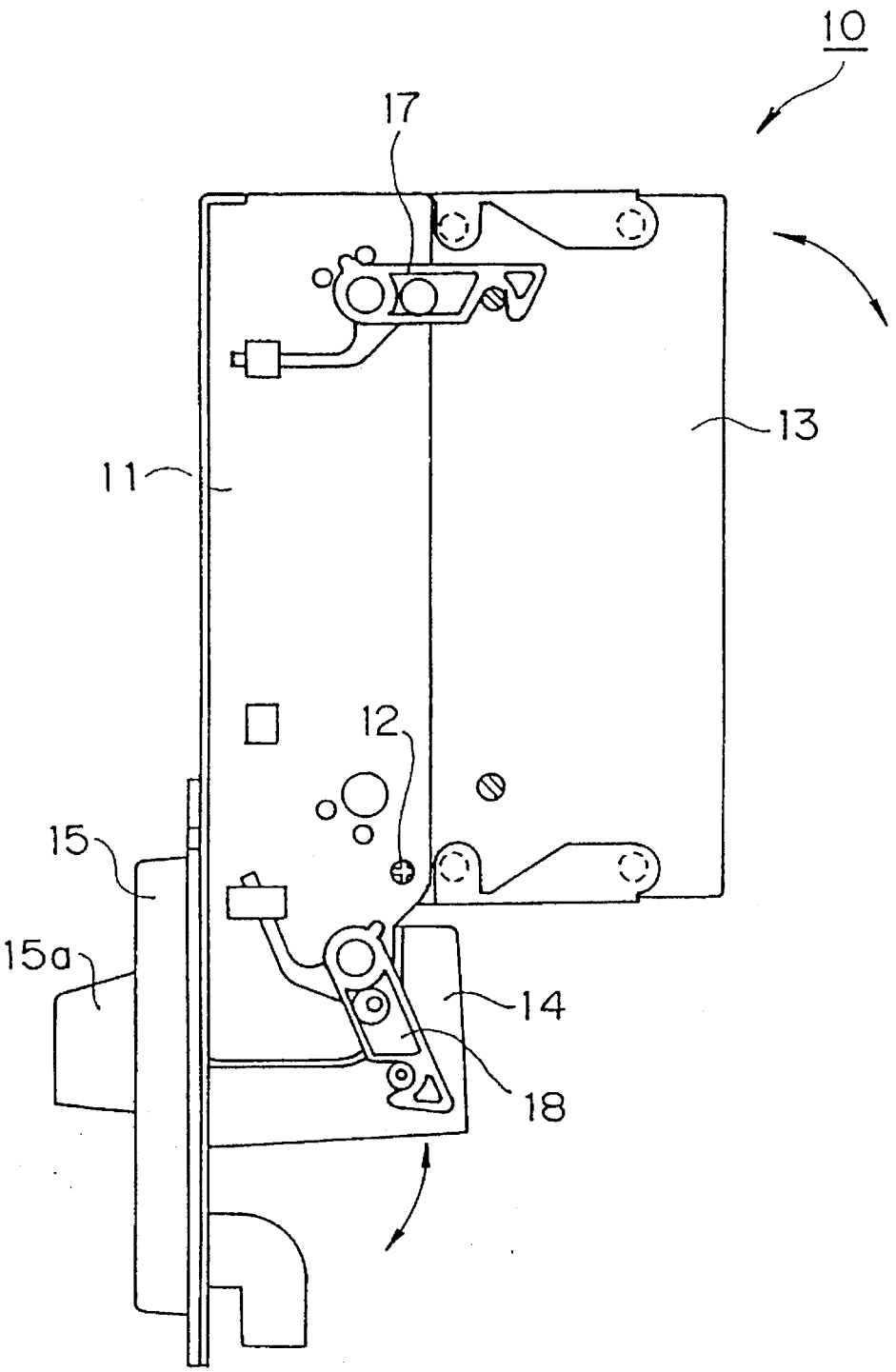
FIG. 1 is a side view of a bill processor according to the present invention.
Figure 2:
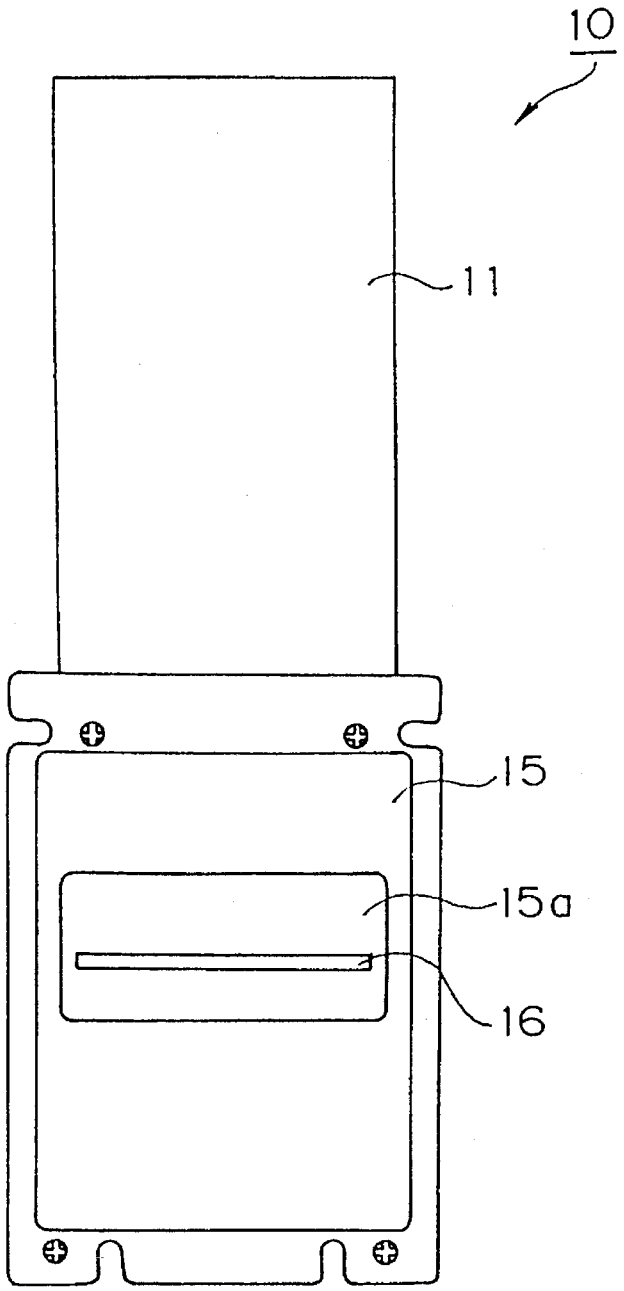
FIG. 2 is a front view of the bill processor.

FIGS. 1 and 2 are side and front views of a bill processor 10 according to the present invention. The processor 10 is substantially L-shaped as viewed from a side thereof as is the conventional processor.

The processor 10 comprises a body 11 including a housing in which a driver mechanism such as a motor is provided, a stacker 13 which is a bill receiving box supported rotatably around a shaft 12 on the back of the body 11, a chute 14 disposed below the body 11, and a front cover 15 disposed at a lower left end of the body 11 and having a raised portion 15*a* with a bill inlet 16, as shown in FIG. 2.

The bill processor 10 is mounted on the front panel of a device such as a vending machine with the raised portion 15*a* of the front cover 15 being exposed outside the device so as to receive a bill through the bill inlet 16.

In FIG. 1, reference numeral 17 denotes a latch for fixedly positioning the stacker 13 supported rotatably around the shaft 12 on the back of the device, and reference numeral 18 denotes a latch for fixedly positioning at a lower portion of the body 11 the chute 14 supported rotatably around a shaft to be described later on the front cover 15. The latches 17 and 18 have the same structure, which will be described later in more detail.

Figure 3:
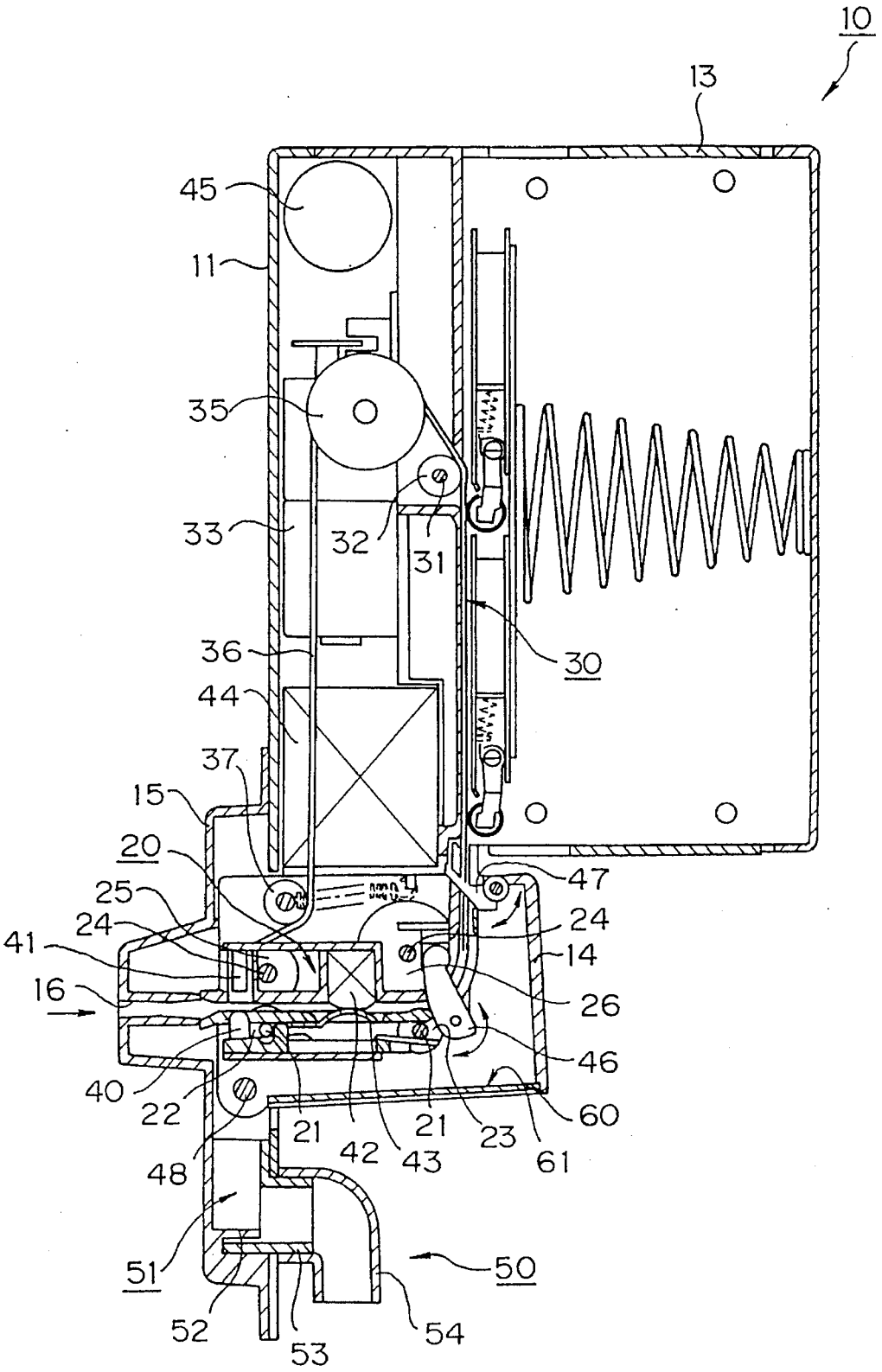
FIG. 3 is a diagrammatic cross-sectional side view of the bill processor.

As shown in a cross-sectional side view of FIG. 3, the bill processor 10 is provided with a first bill conveyance path 20 which conveys horizontally (rightward in FIG. 3) a bill inserted through the bill inlet 16 as shown by an arrow, and a second conveyance path 30 which conveys the bill conveyed from the first bill conveyance path 20 upward in order to stack the bill.

The first bill conveyance path 20 comprises rollers 22, 23 supported rotatably around shafts 21 attached to the chute 14, and pulleys 25, 26 supported rotatably around shafts 24 attached to the body 11 at the positions opposite the rollers 22, 23. The second bill conveyance path 30 comprises a pulley 26 which constitutes part of the first bill conveyance path 20 and a pulley 32 supported rotatably around a shaft 31 attached to an upper portion of the body 11.

A bill conveyance device which conveys a bill along the bill conveyance paths 20, 30 comprises a conveyance belt 36 extending around follower pulleys 25, 26, 32 and a drive pulley 35 driven by a drive motor 33 disposed within the body 11. When the drive pulley 35 is rotated counterclockwise (forward) by the drive motor 33, the bill inserted through the bill inlet 16 is conveyed along the first and second conveyance paths 20 and 30 to the stacker 13 and then received and stored within the stacker 13 by a stacking mechanism (not shown).

Reference numeral 37 denotes an idle pulley which adjusts the tension of the conveyance belt 36 among the pulleys which the belt 36 extends around.

In FIG. 3, reference numerals 40, 41 denote a light emission element and a photodetector, respectively, which cooperate to detect the presence of an inserted bill; 42, a magnetic sensor which judges the genuineness of the inserted bill; 43, a leaf spring which presses an inserted bill against the magnetic sensor 42; 44, a transformer which supplies power to the respective drivers; 45, a motor which drives the stacking mechanism (not shown); 46, a chute lever which senses the passage of a bill in the first bill conveyance path 20; 47, a lever which prevents the inserted bill from being pulled up; and 48, a shaft disposed within the front cover 15 for supporting the chute 14 tunably.

When a bill is inserted into the bill inlet 16 as shown by an arrow, the bill sensor 40, 41 disposed directly downstream of the bill inlet 16 sense the bill to output a bill detection signal. The bill detection signal causes the drive motor 33 to operate to thereby rotate the drive pulley 35 forward.

When the pulley 35 rotates forward, the inserted bill is held between the roller 22 and the conveyance belt 36 by a conveyance force of the belt 36, and is conveyed rightward along the first bill conveyance path 20 in FIG. 3. A magnetic sensor 42 for judging the genuineness of the bill thus conveyed is disposed substantially at the midpoint of the first conveyance path 20.

When the validator 42 judges the bill as a false one, the drive motor 33 and hence the drive pulley 35 rotate reversely (clockwise) to return the bill to outside the body 11 through the bill inlet 16.

When the validator 42 judges the bill as a genuine one, the drive motor 33 continues its forward rotation on the basis of the detection signal. Thus, the bill judged as a genuine one is now conveyed vertically upward along the second bill conveyance path 30 by the drive force of the conveyance belt 36. The drive motor 45 of the stacking mechanism (not shown) is then driven and the stacking mechanism stacks the bill on the stacker 13 provided behind the body 11.

The bill processor 10 has a liquid collector 50 provided at the bottom of the front cover 15 which has the bill inlet 16 for collecting the liquid entered through the bill inlet 16.

Figure 4:
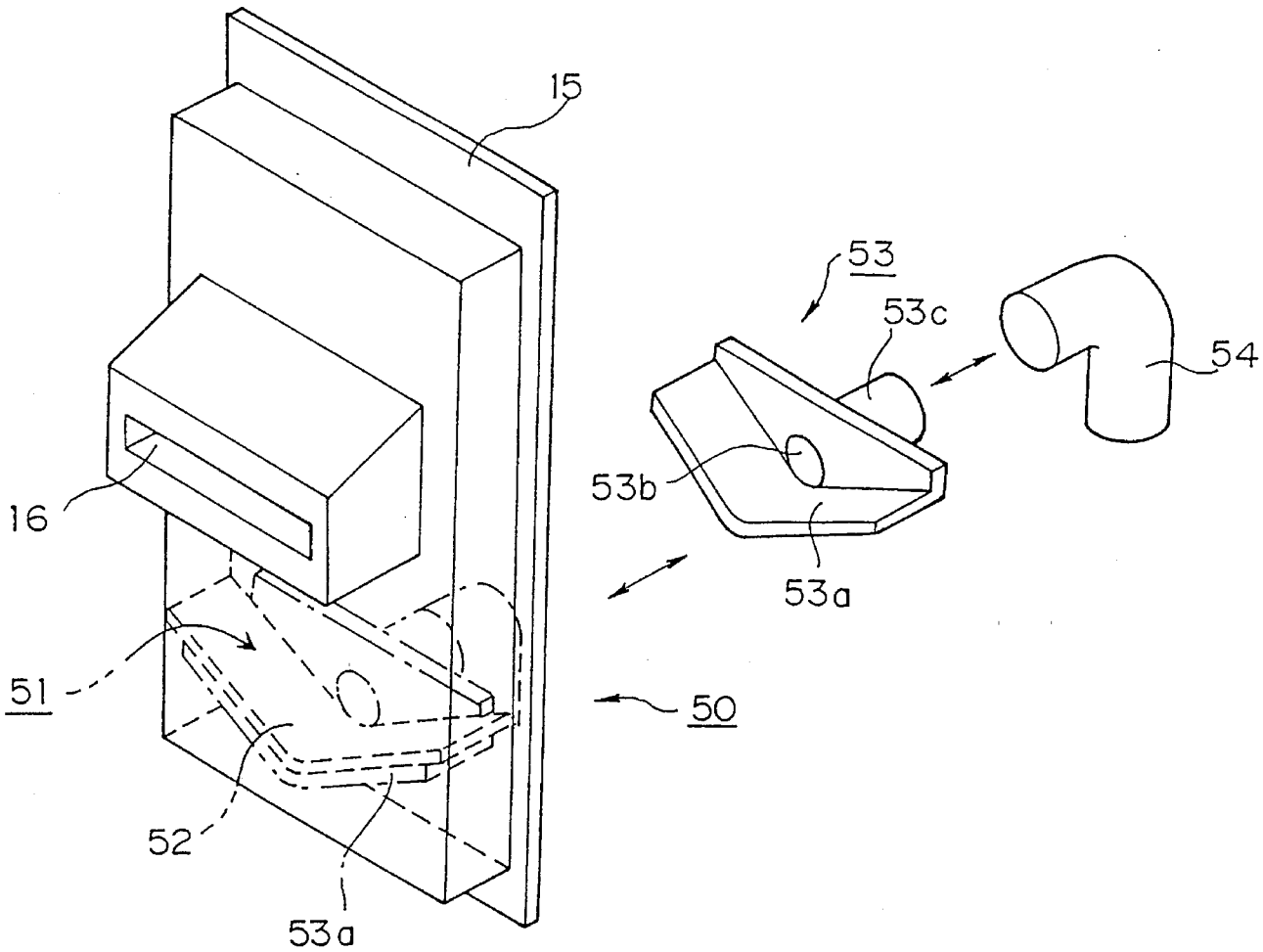
FIG. 4 is an exploded perspective view of a liquid collector.

Referring to FIG. 4, the liquid collector 50 has a concavity 51 formed at the lower portion of the front cover 15 having a U-shaped cross section.

The concavity 51 comprises a rib having a V-shaped front view formed integrally with the lower portion of the front cover 15 and a dam 53 having a V-shaped bottom 53*a* of a shape corresponding to the rib 52. The V-shaped bottom 53*a* of the dam 53 has a hole 53*b* through which fluid communicates with the dam 53 at the valley thereof and to which one end of a pipe 53*b* is connected. To another end of the pipe 53*c*, and L-shaped rubber tube 54 is connected as liquid guiding means.

Referring to FIG. 3, the chute 14 constituting the lower portion of the body 11 has a bottom surface which is covered with a bottom plate 60. The bottom plate 60 is tilted toward the front cover 15 forming a tilted surface 61.

The liquid discharging operation and detailed structure of the liquid collector 50 will be described.

Figure 5:
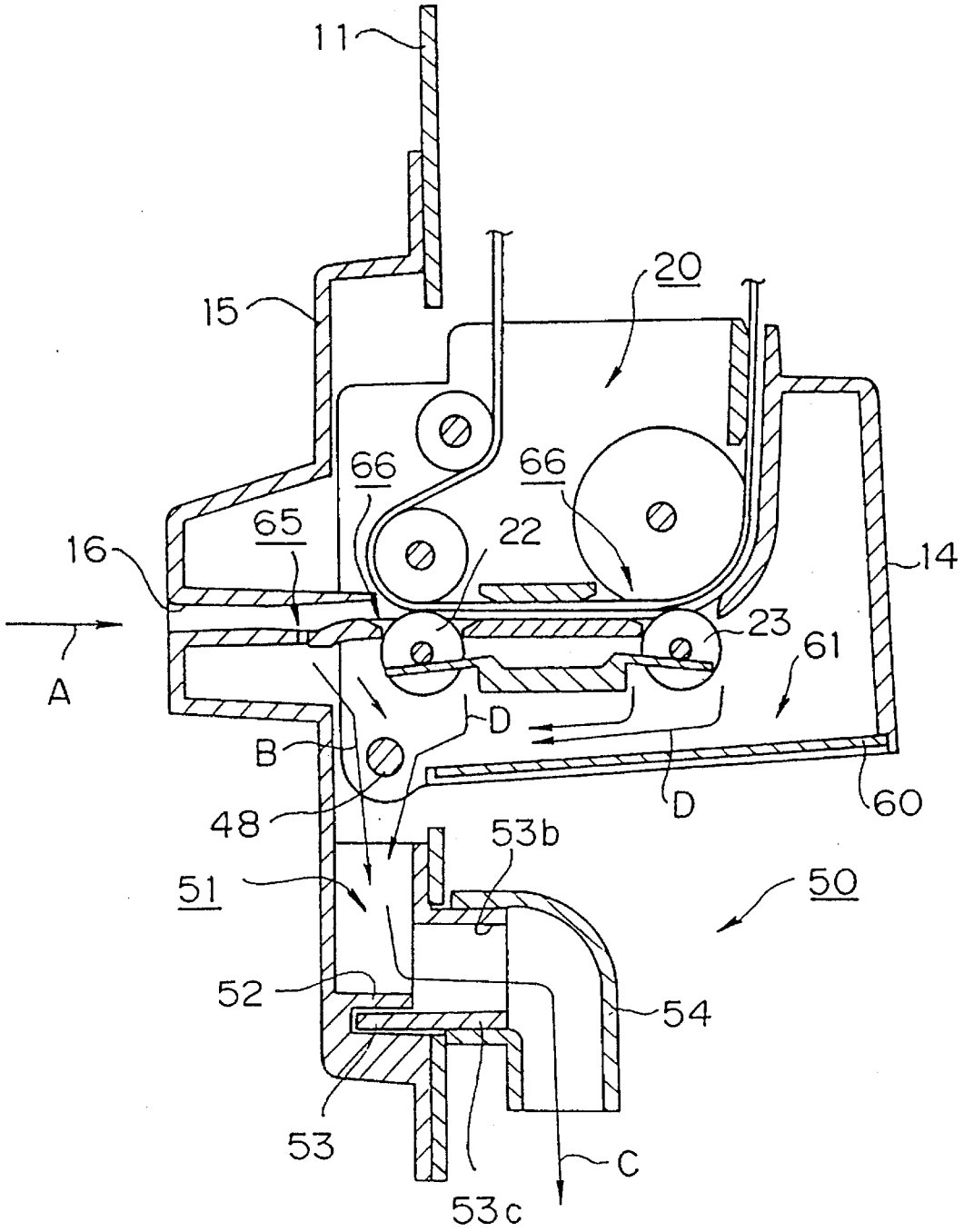
FIG. 5 is an enlarged cross-sectional side view of an essential portion of the bill processor to show the operation of the liquid collector.

Referring to FIG. 5, liquid entered through the bill inlet as shown by an arrow A into body 11 flows downward through a spacing 65 formed in the juncture of the front cover 15 and the first conveyance path 20 as shown by an arrow B, is collected temporarily in the concavity 51 defined by the rib 52 and dam 53, and is discharged to outside the device through the hole 53*b* formed in the dam 53, the pipe 53*c* and the tube 54 as shown by an arrow C.

The liquid which has entered the first bill conveyance path 20 flows downward on the chute 14 through a spacing 66 through which the rollers 22, 23 constituting the first bill conveyance path 20 are partially exposed and then is guided toward the bottom of the front cover 15 along the tilted surface 61 of the bottom plate 60 as shown by arrows D. The liquid is then collected temporarily in the concavity 51 and is discharged to outside of the device as shown by the arrow C, through the hole 53*b*, the pipe 53*c* and the tube 54.

Figure 6:
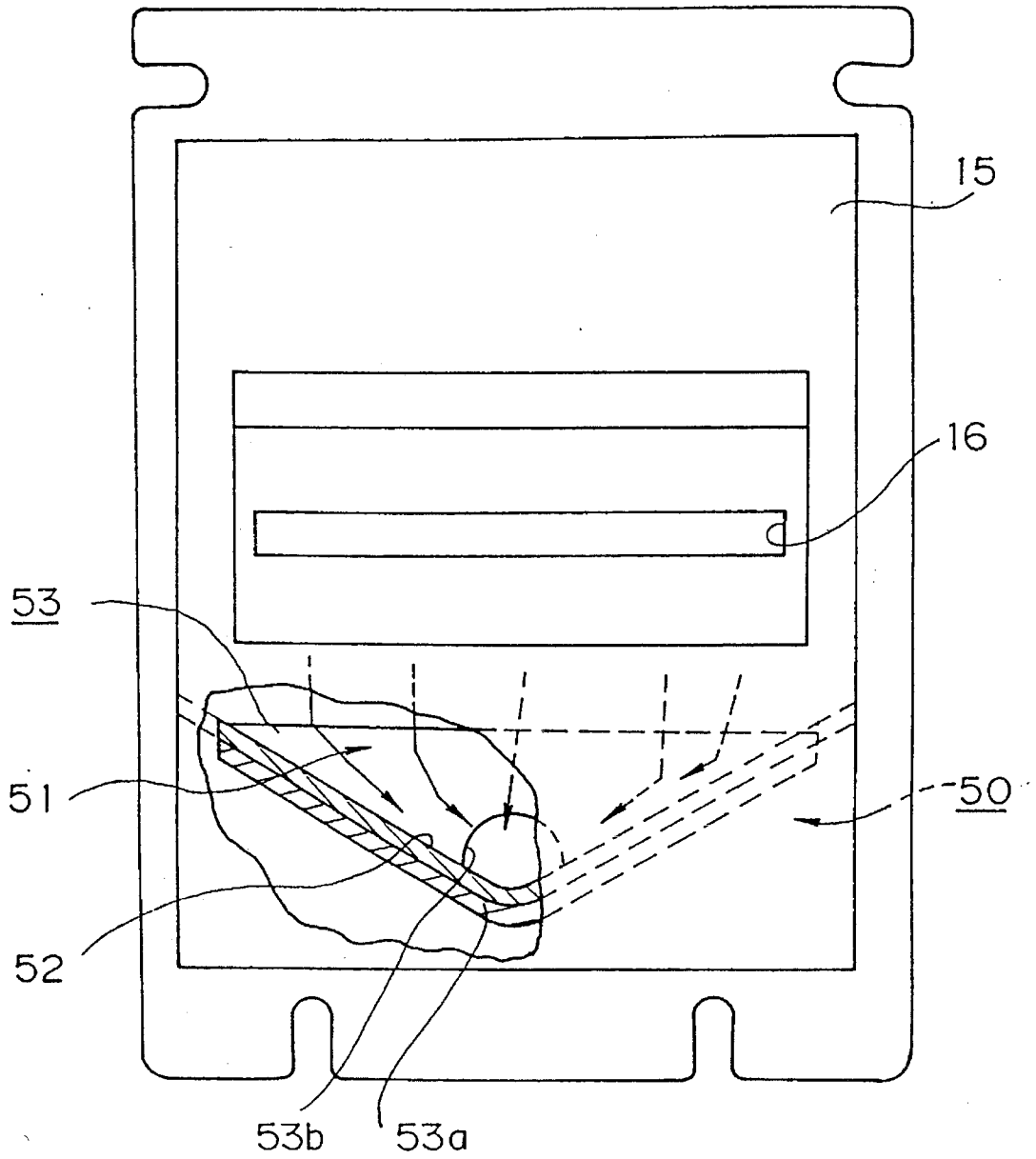
FIG. 6 is a partially broken-away front view of a front cover of the bill processor.

Referring to FIG. 6, the liquid flowing downward from any points along the horizontally extending bill inlet 16 (shown by the respective arrows) is guided to the concavity 51 in the liquid collector 50 and is collected into the hole 53*b* of the dam 53 by means of the rib 52 having a V-shaped front section, and then discharged to outside of the device.

Since the concavity 51 has the V-shaped bottom in which the liquid discharge hole is formed, the liquid is rapidly discharged compared to a concavity having a U-shaped bottom whereby a possible overflow of the liquid collected in the concavity 51 is minimized.

Figure 7:
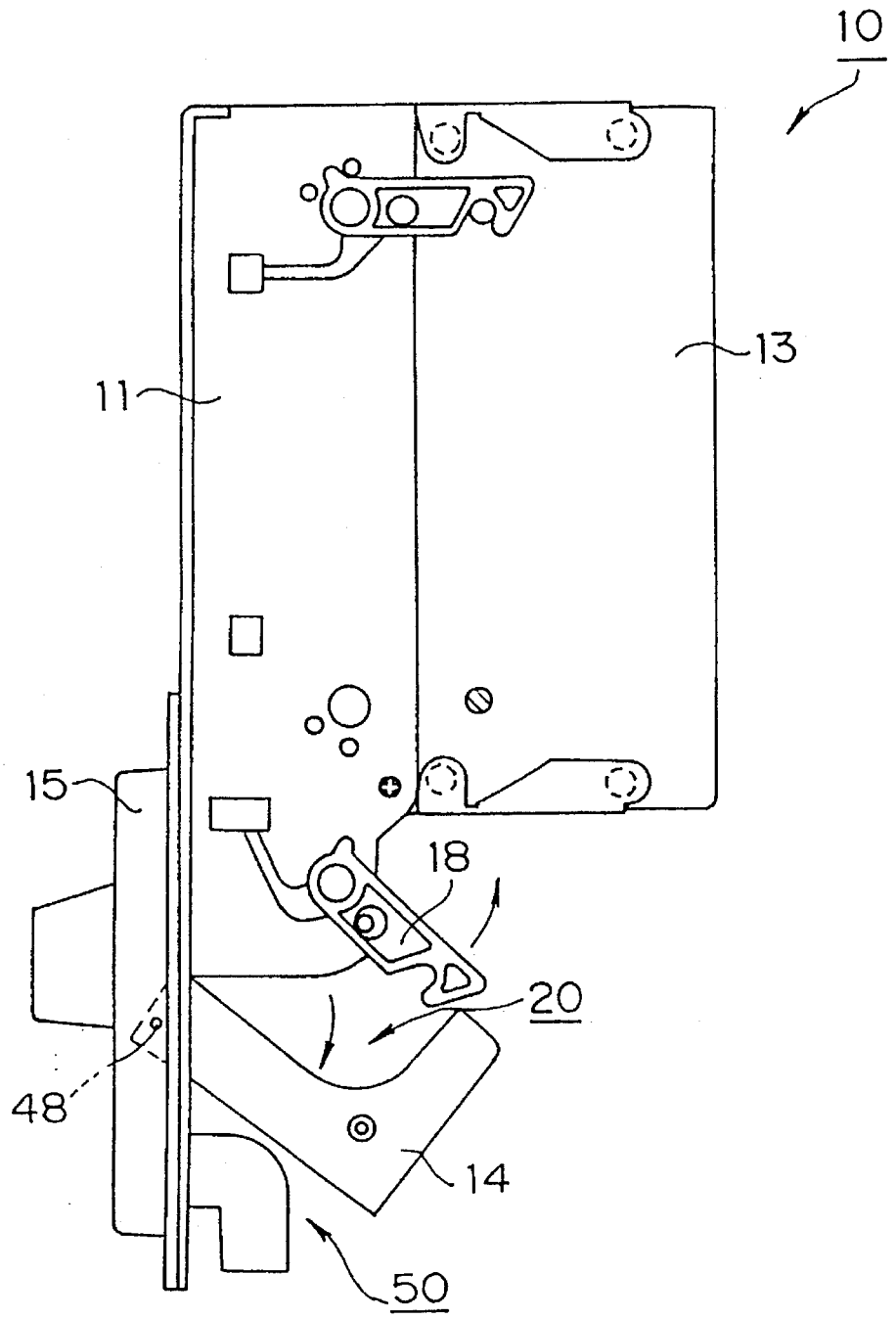
FIG. 7 is a side view of the paper processor with a chute being opened.

As shown in FIG. 5, the liquid collector 50 is disposed at the bottom of the front cover 15 so that a space is formed below the chute 14 in the lower portion of the body 11. Referring to FIG. 7, for the purpose of the maintenance and inspection of the first bill conveyance path 20, the bill validator 42 in the chute 14 and the bill presence sensor 40, 41 (FIG. 3), engagement of the chute 14 by means of the latch 18 is released so as to turn the chute 14 clockwise around the shaft 48 to thereby open the inside of the first bill conveyance path 20. Thus, the maintenance/inspection of the bill processor 10 is easily performed.

According to the bill processor 10 of the embodiment, liquid such as rain drops which is flowed into the bill inlet 16 is collected temporarily in the liquid collector 50 formed at the bottom of the front cover 15 which forms the bill inlet 16 and discharged rapidly through the liquid guide means connected to the liquid collector 50 to outside the device to which the bill processor is mounted. Thus, the liquid flowed through the liquid inlet 16 is prevented from adhering to various components, such as the driving members disposed within the body 11 to which the bill processor 10 is mounted to deteriorate the operations of the various components. In addition, the bill processor 10 and the device to which the bill processor 10 is mounted are effectively protected from vicious mischief including flowing into the processor body liquid such as detergent to thereby prevent a deterioration in the function of the device greatly.

The latches 17, 18 provided on the side of the bill processor 10 will next be described. Since the latches 17, 18 have the same structure, the latch 17 will be described.

Figure 8:
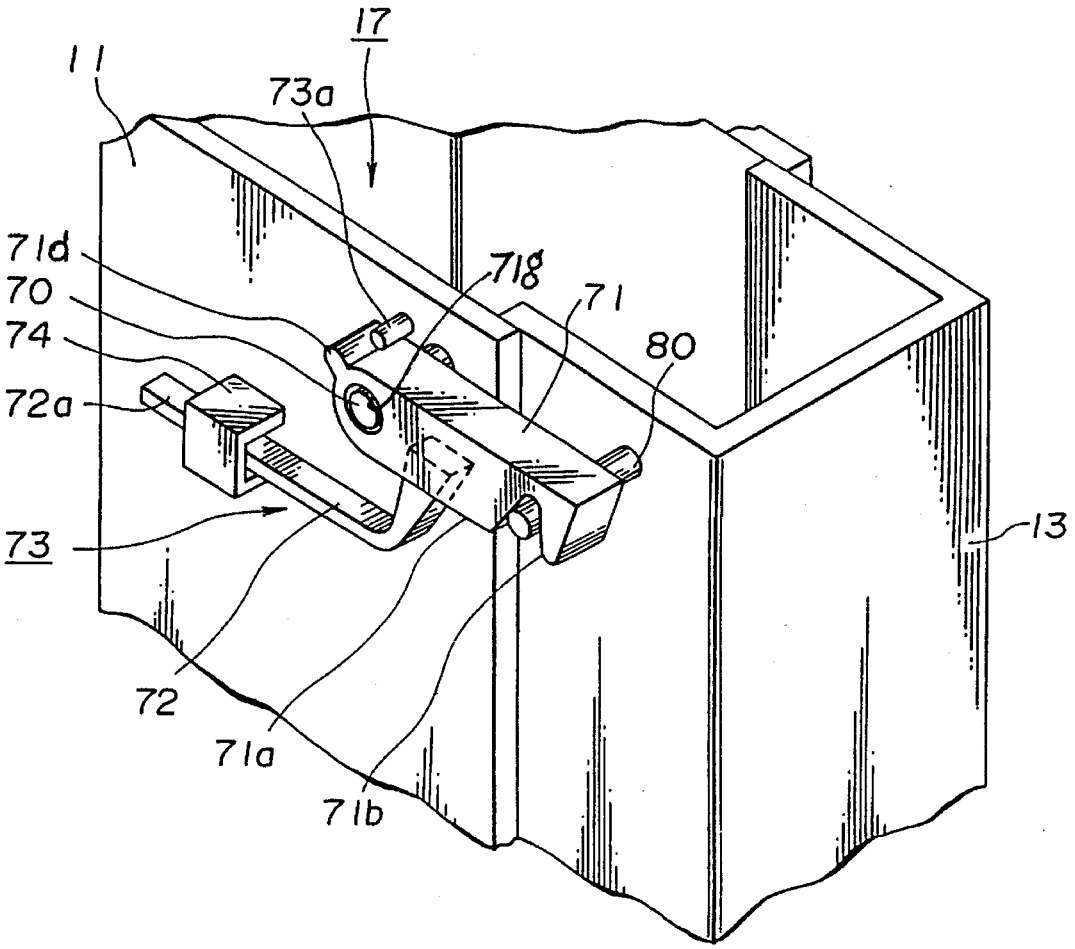
FIG. 8 is a broken-away perspective view of a part of the bill processor to which a latch is provided.

As shown in FIG. 8 which is a diagrammatic enlarged perspective view of an essential element of FIG. 1, the latch 17 comprises a lever 71 supported rotatably around a shaft 70 fixed to a side of the body 11 and energizing means 73 including a substantially J-shaped strip 72 integral at one end with a lower surface 71*a* of the lever 71. The lever 71 and the strip 72 are integrally made of a elastic material such as a synthetic resin.

Attached to a side of the body 11 is a U-shaped engagement member 74 into which the strip 72 constituting the energizing member 74 is inserted at its free end 72*a* for engagement.

Figure 9:
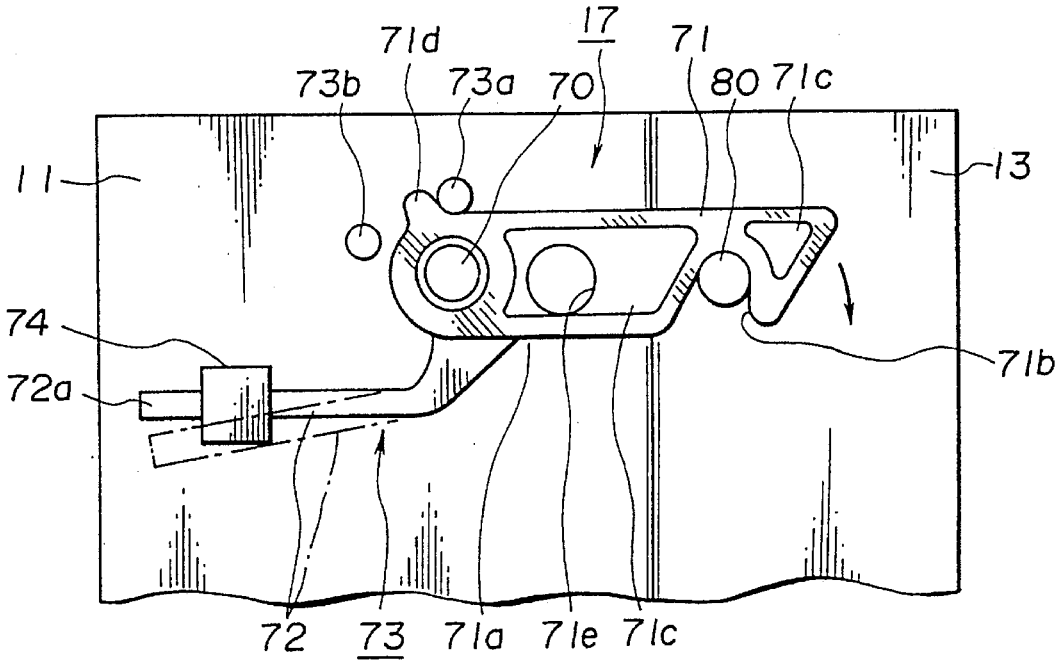
FIG. 9 is a side view of the part of the processor of FIG. 8 with the latch being engaged.

Referring to FIG. 9 which is the front view of the latch of FIG. 8, the lever 71 has a notch 71*b* at an end thereof to be engaged with a pin 80 fixed to the side of the stacker 13. The lever 71 has a thinned area 71*c* which increases its modulus of section and hence its mechanical strength. A rib 71*d* is integrally formed at another end of the lever 71.

When the lever 71 is fitted on the shaft 70 by a bearing hole 71*g*, the rib 71*d* is positioned between a pair of protrusions 73*a*, 73*b* formed on the body 11 such that when the lever 71 is turned around the shaft 70, the rib 71*d* abuts on one of the protrusions 73*a*, 73*b* to thereby limit the turning of the lever 71 within a predetermined angle.

In FIG. 9, reference numeral 71*e* denotes a hole formed in a side of the lever 71 which acts, like the rib 71*d*, to limit the turning of the lever 71 within a predetermined angle, as will be described later in more detail.

The operation of the latch 17 and its detailed structure will now be described. As shown in FIG. 9, when the lever 71 is fitted on the shaft 70, the substantially J-shaped strip 72 is bent as shown by a dot-dashed line, and inserted at its rear end 72*a* into the U-shaped engagement member 74 attached to the side of the body 11. When the strip 72 is bent, an elastic force is produced therein which becomes an energizing force to turn the lever 71 clockwise around the shaft 70.

Thus, the notch 71*b* of the lever 71 is engaged with the pin 80 to thereby ensure the positioning of the stacker 13 relative to the body 11.

When the notch 71*b* is engaged with the pin 80, the lever rib 71*d* abuts on the protrusion 73*a* so that the rib 71*d* limit the turning of the lever 71 within the predetermined angle.

Figure 10:
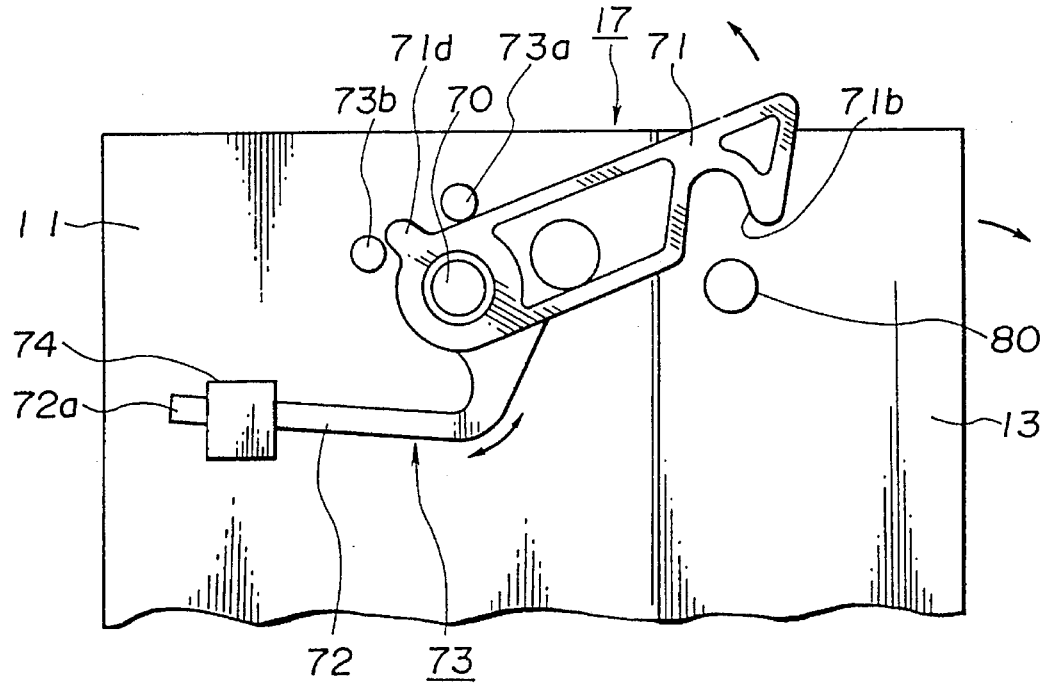
FIG. 10 is a side view of the part of the processor of FIG. 8 with the latch being disengaged.

In order to disengage the notch 71*b* from the pin 80, the lever 71 is turned counterclockwise by applying a force to its end against the energizing force of the energizing means 73 as shown in FIG. 10. As the rib 71*d* abuts on the protrusion 73*b*, the turning of the lever 71 is limited within the predetermined angle.

When the bills stored in the stacker 13 are to be collected, the notch 71*b* of the lever 71 is disengaged from the pin 80 as shown in FIG. 10, and the stacker 13 is turned clockwise around the shaft 12 as shown in FIG. 1. This creates a spacing between the stacker 13 and the body 11 to thereby allow the bills stored in the stacker 13 to be taken out through the spacing.

While in the above-described embodiment, the rib 71*d* is used as a part of the limiting means which limits the turning of the lever 71 within a predetermined angle, the present invention is not limited to the particular embodiment. In a modification, the limiting means may consist of a protrusion 90 fixed to the side of the body 11 and a hole 71*e* formed in the side of the lever 71 in which the protrusion 90 is inserted as shown in FIG. 11.

Figure 11:
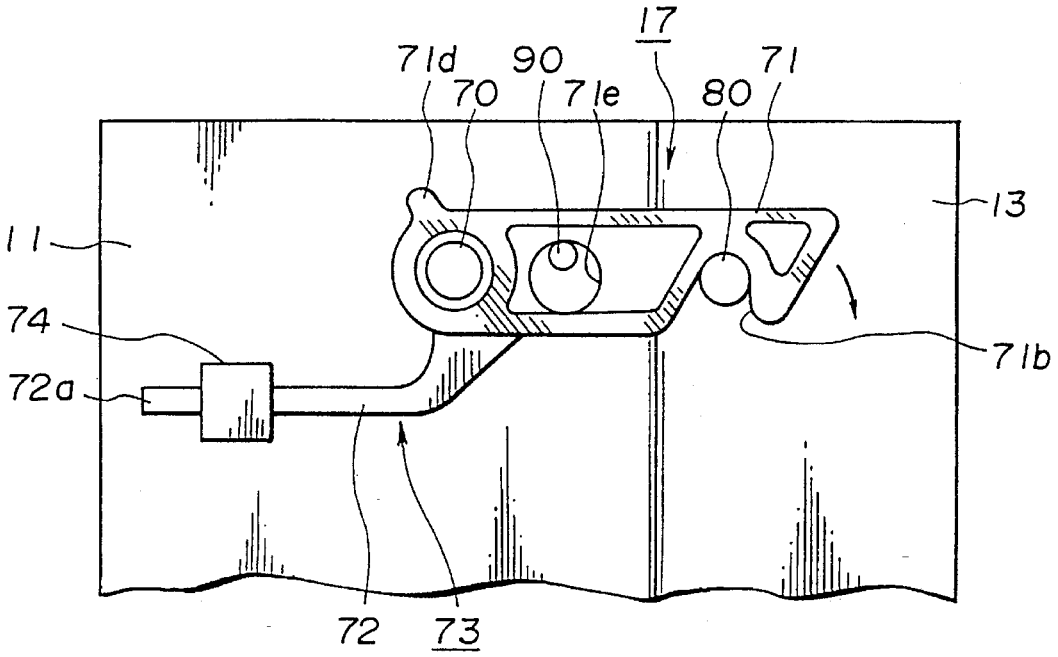
FIG. 11 shows a latch with another lever rotation limiting means.

Referring to FIG. 11, when the stacker 13 is in a normal operative position, the protrusion 90 fixed to the body 11 abuts on an upper inner peripheral surface 71*e* of the hole 71*e* to limit the turning of the lever 71 within the predetermined angle.

Figure 12:
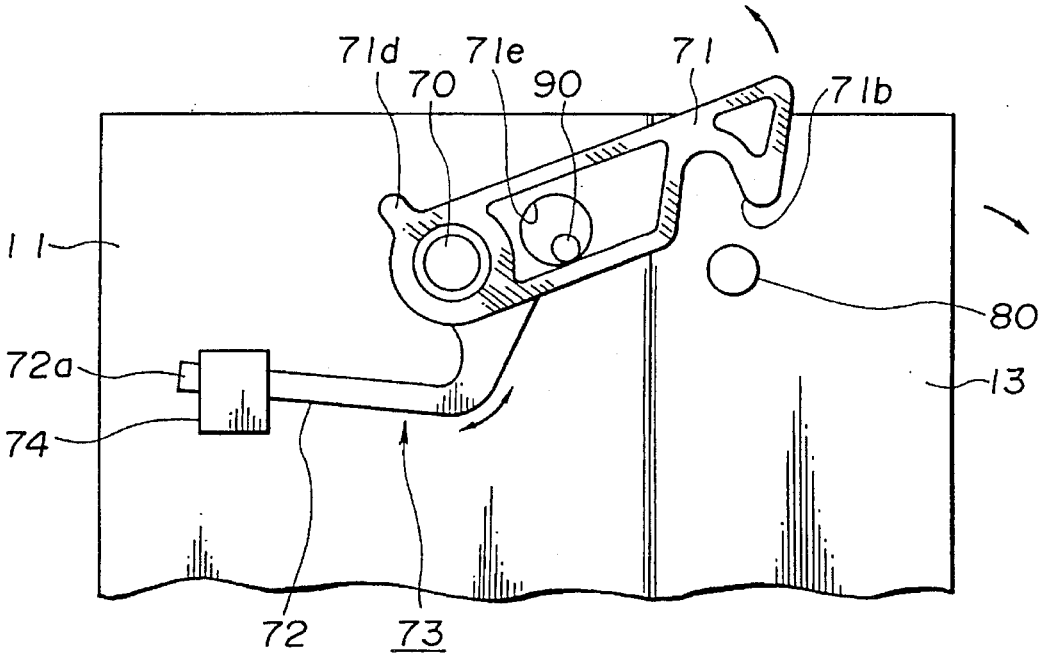
FIG. 12 shows the latch of FIG. 11 which is in disengaged state.
Figure 13:
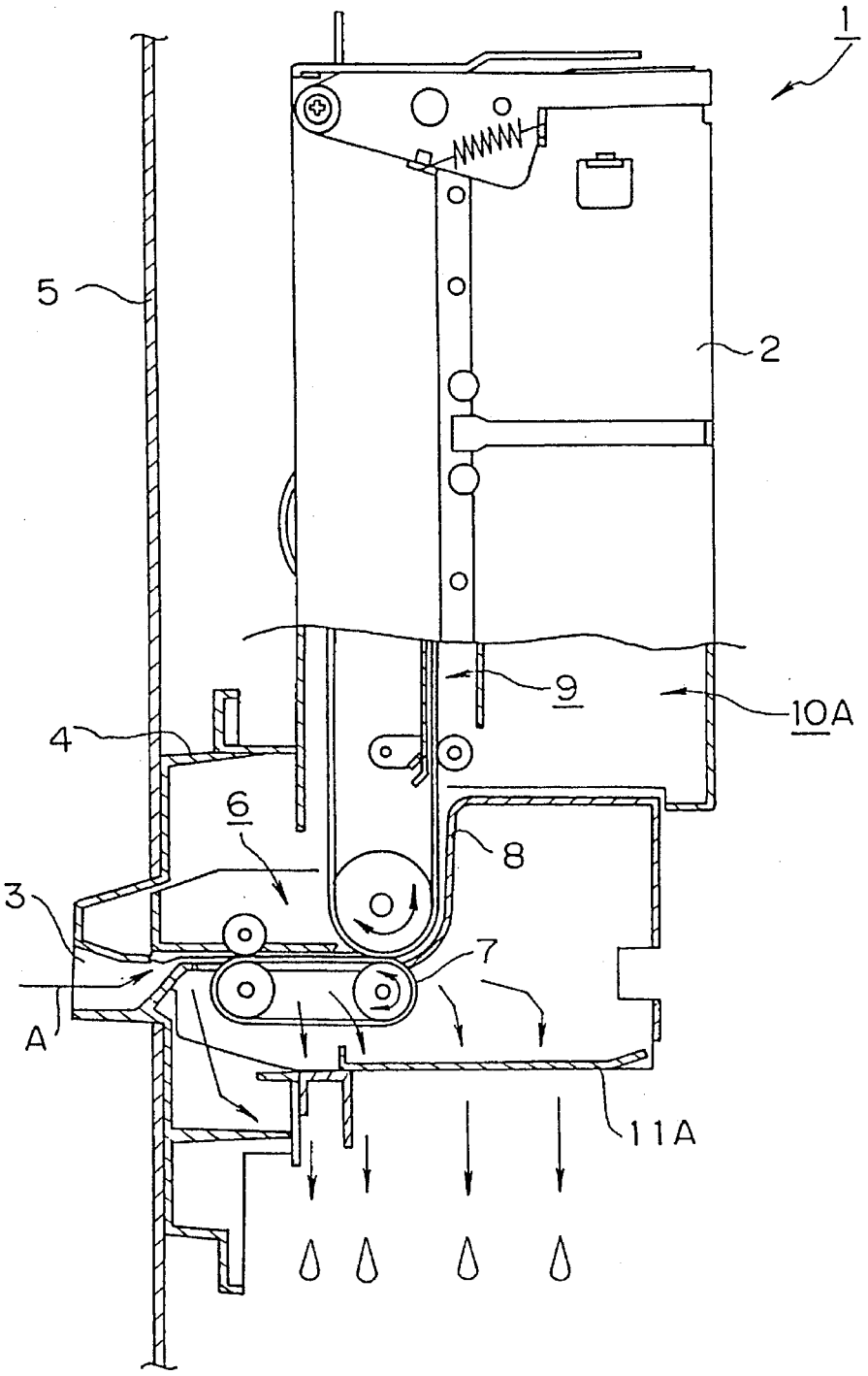
FIG.13 (PRIOR ART)
FIG. 13 is a cross-sectional view of a conventional bill processor.

For maintenance, the notch 71*b* of the lever 71 is disengaged from the pin 80, the lever 71 is turned by applying a counterclockwise force to the free end of the lever 71 against the energizing force of the energizing means 73 as shown in FIG. 12. The protrusion 90 fixed to the body 11 abuts on a lower inner peripheral edge of the hole 71*e* to limit the turning operation of the lever 71 within the predetermined angle.

In the modification in which the limiting means comprises the protrusion 90 fixed to the body 11 and the hole 71*e*, the protrusions 73*a*, 73*b* of FIG. 9 are not needed.

While in the above embodiment the energizing means 73 comprises a flat strip member 72, the present invention is not limited to the embodiment. For example, the strip 72 may be modified so as to have a plurality of bends in the intermediate portion thereof in order to increase or decrease an elasticity produced when the strip 72 is bent.

While in the embodiment the latch 17 is applied to the bill processor 10, a device to which the latches 17, 18 are applied is not limited to the bill processor 10, but applicable to many kinds of devices.

According to the latches 17, 18, the energizing means 73 comprises the strip integrally formed with the lever 71, so that a separate element such as a coil spring is not necessary and therefore work to attach the element at a predetermined position is not required as in conventional ones. Thus, both the number of parts of the latches and the number of steps for assembling the latches are reduced, so that the latches 17, 18 are provided inexpensively and the efficiency of manufacturing devices which use the latches 17, 18 is further increased.

The invention can be carried out in various forms without departing from the spirit or main features thereof. Thus, the above embodiment is solely illustrative in every respect and should not be interpreted as restrictive. The scope of the present invention should be limited by the attached claims and not restrained by the text of the specification. It is to be noted that various changes and modifications which belong to an equivalence of the claimed invention should fall within the present invention.

What is claimed is:

1. A latch device for connecting and releasing a first body (11) relative to a second body (13) comprising:

a lever (71) formed at one end portion thereof with a bearing hole (71*g*) through which a shaft (70) fixed to the first body (11) is detachably inserted and at another end portion thereof with a recess (71*b*) for detachably engaging with a pin (80) fixed to the second body (13);

a strip member (72) of a substantially J-shaped configuration including a base end and a free end (72*a*), the strip member (72) being formed integrally with the lever (71), the base end being fixed to a side of the lever (71) at which the recess (71*b*) is located and the free end (72*a*) extending across the bearing hole (71*g*); and an engagement member (74) of a substantially U-shaped configuration, defined by a bight portion and a pair of leg portions, said leg portions being fixed to the first body (11) thereby forming a hole through which the free end (72*a*) of the strip member (72) is slidably inserted.

2. The latch device according to claim 1 wherein the lever (71) and the J-shaped strip member (72) are made of an elastomeric material integrally formed with each other.

3. The latch device according to claim 1 wherein the lever (71) has a rib (71*d*) positioned between a pair of protrusions (73*a*, 73*b*) of the first body (11) whereby the rib (71*d*) abuts against one of the protrusions (73*a*, 73*b*) when the lever (71) turns to limit the turning of the lever (71) within a predetermined rotational angle.

4. The latch device according to claim 1 wherein the lever (71) has a hole (71*e*) which receives a protrusion (90) formed on the first body (11) so that the protrusion (90) abuts against an inner peripheral surface of the hole (71*e*) when the lever (11) turns thereby limiting the turning of the lever (71) within a predetermined rotational angle.

5. The latch device according to claim 2 wherein the elastic material is an elastic synthetic resin.

* * * * *